US005647093A

United States Patent [19]

Engel et al.

[11] Patent Number: 5,647,093

[45] Date of Patent: Jul. 15, 1997

[54] SWEEPER WITH DUAL SEAL FILTER

[75] Inventors: Gregory J. Engel, Plymouth; Robert D. Hennessey, Eden Prairie; Timothy G. LaRocque; Terence A. Peterson, both of Plymouth, all of Minn.

[73] Assignee: Tennant Company, Minneapolis, Minn.

[21] Appl. No.: 664,616

[22] Filed: Jun. 18, 1996

[51] Int. Cl.[6] ..... B01D 46/04

[52] U.S. Cl. ..... 15/352; 55/300; 15/349

[58] Field of Search ..... 15/347, 349, 352; 55/300

[56] References Cited

U.S. PATENT DOCUMENTS

| | | | |
|---|---|---|---|
| 2,784,440 | 3/1957 | Newport . | |
| 4,328,014 | 5/1982 | Burgoon et al. . | |
| 4,345,353 | 8/1982 | Sommerfeld | 15/352 X |
| 4,974,283 | 12/1990 | Holsted et al. . | |
| 4,979,260 | 12/1990 | Holsten et al. . | |
| 5,013,333 | 5/1991 | Beaufoy et al. | 55/300 X |
| 5,090,083 | 2/1992 | Wulff | 15/352 X |
| 5,194,077 | 3/1993 | Bargiel et al. . | |

*Primary Examiner*—Chris K. Moore

*Attorney, Agent, or Firm*—Dorn, McEachran, Jambor & Keating

[57] ABSTRACT

A sweeping machine includes a sweeping brush, a hopper having an inlet for receiving debris from said sweeping brush, an opening in said hopper and a vacuum system for creating an air flow path from the hopper inlet through the opening. There is a filter positioned in the hopper opening and a peripheral flexible seal between the inlet side of the filter and the hopper opening. A vibratory filter cleaner is positioned adjacent the outlet side of the filter to impart vibration thereto. There is a closure which encloses the filter and the filter cleaner and there is a second peripheral flexible seal between the filter outlet side and the closure. The filter is movable between the spaced peripheral seals at its inlet and outlet sides whereby vibratory cleaning force applied by the filter cleaner causes vibration of the filter to provide cleaning thereof.

13 Claims, 3 Drawing Sheets

20
24
26
28
30
32
34
36
38
42
44
45
46
48
50
52
54
56
58
60
62
64
66
68
70
71
72
76
78
80

SWEEPER WITH DUAL SEAL FILTER

THE FIELD OF THE INVENTION

Traditionally pleated filter panels have provided the dust filtering system on sweepers of the type manufactured by Tennant Company of Minneapolis, Minn., the assignee of the present application. The filter panel has a seal or gasket of foam material on the bottom side of the filter frame and the filter is securely fastened to the top of the hopper. A cover is placed over the filter and hopper and vacuum is applied to the cover causing air to flow through the filter. This air flow carries dust, created by the brush during sweeping, into the filter. As the filter becomes plugged with dust, the vacuum in the cover increases and the air flow decreases. Eventually, the air flow will be reduced to the extent that dust created by the sweeping brush escapes out from around the brush compartment at the bottom of the machine. To prevent this from happening, a filter shaker is used, which shaker vibrates the filter panel, causing the dust to fall out of the filter so that high air flow returns and dust controlled sweeping can be resumed.

There are several problems with the above-described system. First, as the filter plugs with dust and the vacuum in the cover increases, the filter seal tends to be pulled away from the sealing surface, causing leaks. Further, if there is a leak path or tear in the filter seal, dusty air from inside the hopper is pulled around the filter and is then blown out through the vacuum fan. In addition, the filter, being fastened securely to minimize lifting due to the vacuum, is not readily removable for cleaning or replacement without tools. Moreover, a solid clamping of the filter also makes the task of shaking the dust from the filter more difficult since the filter is physically restrained from movement.

The present invention solves many of the problems described above associated with the traditional design of a pleated filter. A second seal has been added on the top or cover side of the filter panel in addition to the bottom seal. This permits the filter panel to float on two sets of seals. The filter is held in place, and the seals are compressed, by clamping the hopper cover onto the filter seals with mechanical latches. A filter shaker is mounted either directly on the filter or fastened to the inside of the cover so that it rests upon the filter when the cover is closed.

The above-described design has several advantages. First, the floating filter seal tends to be self-energizing. When vacuum is applied to the hopper cover, the filter is pulled toward the cover, compressing the seals more tightly instead of pulling away as in the traditional design described above. Second, if a leak path or tear is present in the top seal, outside clean air is pulled in through the vacuum fan instead of dusty air from inside the hopper. The filter with a dual seal is much less sensitive to seal damage than the traditional filter. Moreover, the filter and shaker are now easily removable without tools, since the hopper cover and shaker are clamped in place without fasteners. When the cover is unlatched and opened, the filter is free to be lifted out. Further, since the filter panel floats between two sets of seals, it is easier to move the filter panel during shaking, making the cleaning system far more effective than prior art filters.

SUMMARY OF THE INVENTION

The present invention relates to sweeping machines and more particularly to an improved filter system for sweeping machines.

A primary purpose of the invention is a filter system for a sweeping machine in which the filter may be removed for cleaning or replacement without the use of tools.

Another purpose is a filter system for the use described which has top and bottom seals, with the filter floating between such seals providing enhanced vibratory cleaning.

Another purpose is a filter system as described in which outside air is drawn into the air path by the vacuum system in the event of a seal leak.

Another purpose is a filter system which may be serviced solely by movement of a single enclosure and without the need for tools.

Another purpose is a filter system of the type described in which the vibratory cleaning assembly is positioned directly on top of the filter, is yieldingly held in that position, and imparts a vibratory cleaning motion to the filter which is floating between spaced sealing elements.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
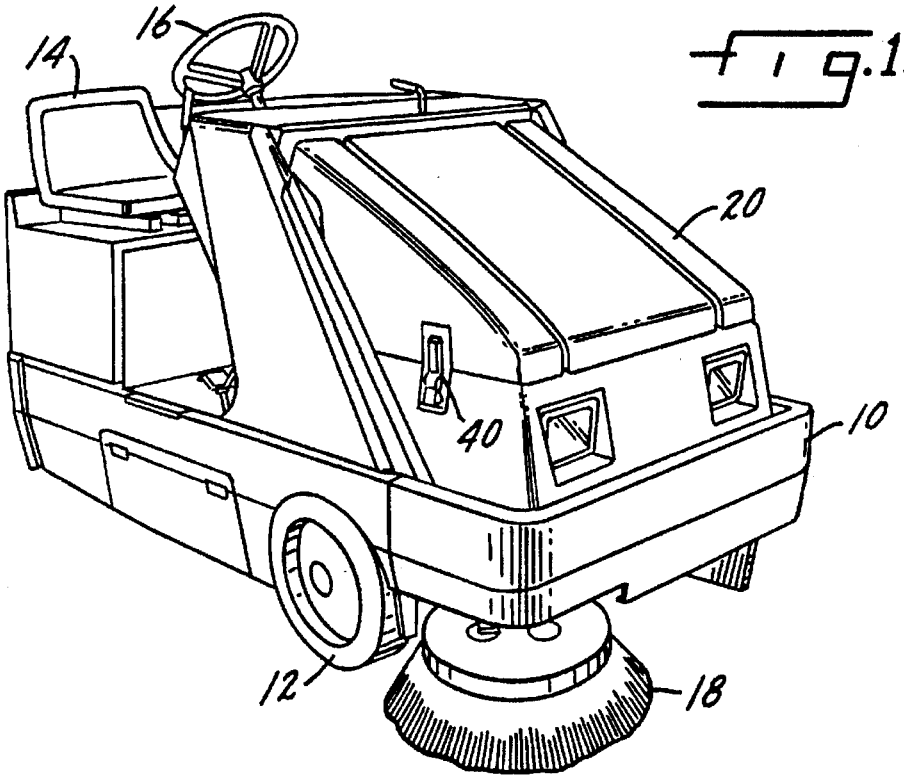
FIG. 1 is a diagrammatic illustration of a sweeper of the type described.

FIGS. 1–4 illustrate a typical sweeping machine of the type manufactured by Tennant Company of Minneapolis, Minn. The machine includes a frame 10 having front wheels 12, a driver seat 14 with a steering wheel 16 by which the driver operates the machine and directs it to sweep a desired area. The machine has a side sweeping brush 18, which is a circular rotary brush, and a main sweeping brush, not shown, which will move dust and debris into the machine hopper. The machine may be driven by an engine or by electric power.

Figure 2:
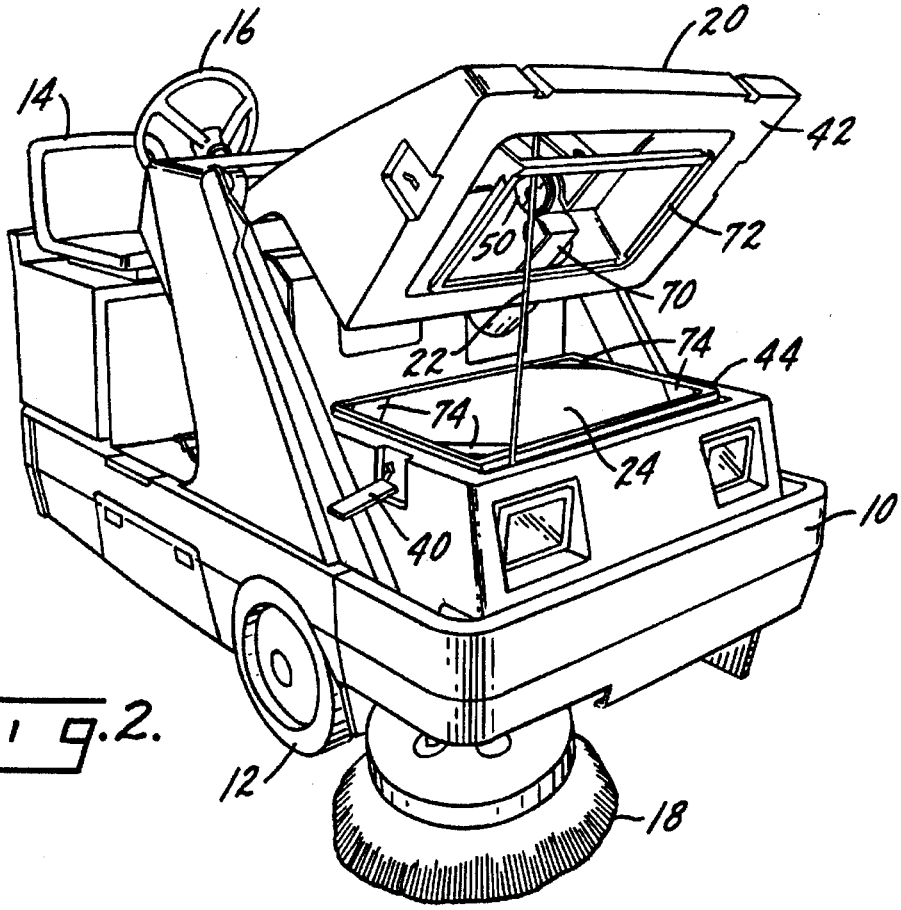
FIG. 2 is a diagrammatic illustration of the sweeper of FIG. 1, with the filter enclosure in an open position.

As shown particularly in FIG. 2, the front of the machine includes a cover 20 which is hinged to the chassis and which may be raised up and held in a raised position by a rod 22. When the cover 20 is so raised, it provides access to a filter indicated generally at 24 whose use and location on the sweeping machine will be described hereinafter. The cover 20, when in the raised position, not only provides access to the filter 24, but also to the vibratory cleaning mechanism for the filter which is shown in FIG. 2 as being attached to the inside of the cover 20 and will be described in more detail in connection with FIG. 3.

Figures 3, 4:
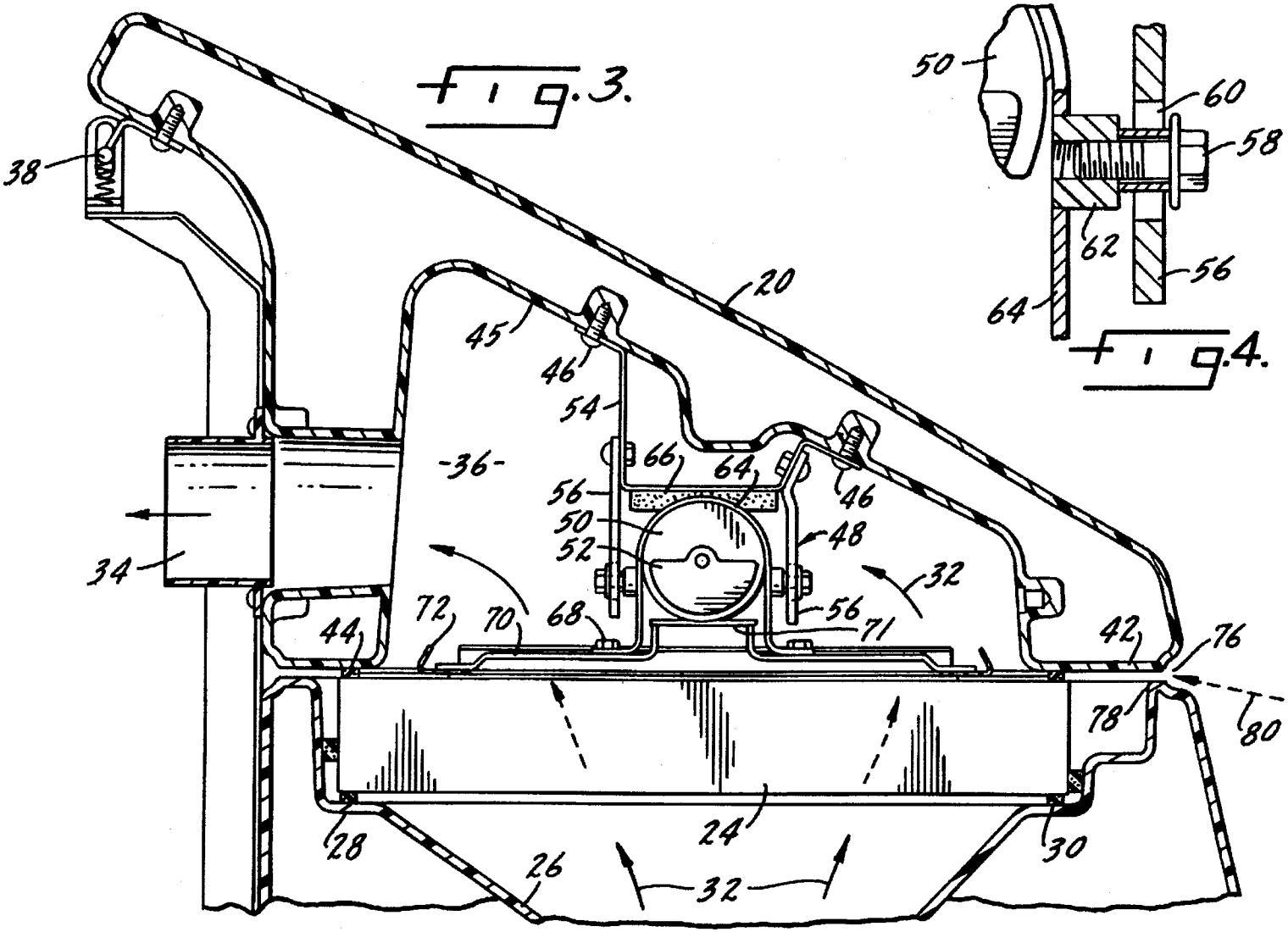
FIG. 3 is an enlarged vertical section through the filter and filter cleaning system of the sweeper in FIGS. 1 and 2.
FIG. 4 is an enlarged illustration of the mounting of the vibratory cleaner to the filter enclosure.

The sweeping machine will include the side brush 18 which will move dust and debris into the path of the main brush, which will move dust and debris into a hopper, the upper end of which is indicated at 26 in FIG. 3. There is a ledge 28 upon which the filter 24 is positioned. A peripheral elastomeric flexible seal 30 supports the filter 24 on the ledge 28. The filter 24 is preferably a pleated filter, although the invention should not be limited to this particular form of filter. The filter is necessary to remove dust and small particles from the air stream which follows the direction of the arrows 32 in FIG. 3 and which will exhaust through a port 34 in the cover to a vacuum fan which is located within the chassis 10 and will be shown in the embodiment of FIGS. 5 and 6. However, for purposes of explanation, there is a vacuum fan in the FIG. 1 through 4 embodiment of the invention, which fan is mounted on the chassis 10 and creates an air flow path from the hopper inlet where dust and debris are moved by the brushes, through the hopper 26, through the filter 24, and into a chamber 36 positioned above the filter and then out through the described port 34.

The cover 20, as particularly illustrated in FIG. 3, is hinged by means of spaced spring-loaded floating hinges 38 to the chassis. The cover is rotatable about the spring-loaded hinges 38 from the closed position of FIG. 1 to the open position of FIG. 2. When in the closed position, the cover 20 may be locked by mechanical latches, one of which is indicated at 40, there being such a latch on each side of the cover 20. The spring-loaded floating hinges hold the cover away from the filter seals as the cover is being closed and then provide a compressing force from the cover on the seals once the cover has been moved to the closed position. In prior art sweeping machines, when the cover is being closed, there is the potential for damage to the seal because of the wiping action of the cover on the seal.

The cover 20 has a lower peripheral surface 42 which faces the filter and which will be positioned against a peripheral elastomeric flexible seal 44 when the cover 20 is in the closed position of FIGS. 1 and 3. Thus, the pleated filter 24 is held between two elastomeric seal elements which permit the filter to float in its operable position.

Attached to the underside wall 45 of the cover 20, by fastening means 46, is a shaker assembly indicated generally at 48 which will include a motor 50 which drives an eccentric weight 52. There is a bracket 54 which extends downwardly from the underside wall 45 of the cover 20 and mounts a pair of arms 56. The arms 56 mount the motor and eccentric weight and permit vibration of these elements as the eccentric weight is turned by the motor. Note particularly the arrangement of FIG. 4 in which a bolt 58 movable vertically within a slot 60 in an arm 56 is threadedly attached to a boss 62 of the motor support 64. This connection permits movement of the motor and the eccentric weight relative to the cover and the chassis when the motor is operated so as to impart vibration to clean the filter 24.

There is a foam cushion 66 mounted on the underside of bracket 54, with the foam cushion providing downward yielding pressure on the motor support 64 which is attached by fasteners 68 to a mounting plate 70. The mounting plate 70 has a portion 71 in contact with the motor support such that rotation of the weight causes the mounting plate 70 to vibrate. The plate 70 in turn is attached to a peripheral frame 72 which is seated upon four corner supports 74 of the filter 24 when the cover 20 is in the closed position of FIGS. 1 and 3. The shaker assembly is directly mounted on the filter and the assembly and filter vibrate together as the shaker is operated. The foam cushion 66 may vary in stiffness, depending upon the desired filter vibration. In some applications the foam cushion may not be required. The vibration applied to the filter will cause its pleats to be moved with the result that the dust collected in the filter as the sweeper is operated will be released and will drop down into the hopper where it will be unloaded with other debris.

The top seal 44 is self-energized due to the vacuum applied by the vacuum fan. The top seal does not need to be clamped solidly to effectively prevent dust from entering the fan, as at least a portion of the sealing pressure is applied by the vacuum created by the vacuum fan. The filter panel is clamped loosely between the seals 30 and 44 and thus it floats in this position and is therefore free to vibrate when the shaker is activated, making the shaker more effective. The cover 20, when opened, provides complete access to both the filter 24 and shaker 48 for maintenance or replacement.

There is a peripheral gap 76 between the cover surface 42 and an upper peripheral shoulder 78 of the hopper structure, with this peripheral gap providing means for outside air to access the top seal of the filter, as indicated by the dashed arrow 80. If a leak path or tear should be present in the top seal, outside clean air in the direction of the arrow 80 is pulled in through the vacuum fan instead of dusty air from inside the hopper. The filter is thus less sensitive to seal damage than a traditional filter and dirty air will not be drawn into the vacuum fan in the event there is a loss of sealing effect at the upper periphery of the filter 24.

Of importance in the design of the sweeper shown in FIGS. 1–4 is the provision of air gap 76 to insure that dirty air will not be drawn into the vacuum fan in the event the upper seal is not tight; the fact that the seals are self-energizing due to the applied vacuum; the use of a double seal; and that no tools are required to remove and replace the filter element 24 or to maintain the shaker 48. The latches 40 are unlatched, the cover 20 is raised to the position of FIG. 2, and the filter and shaker are completely accessible. No tools are required to remove the filter.

Figure 5:
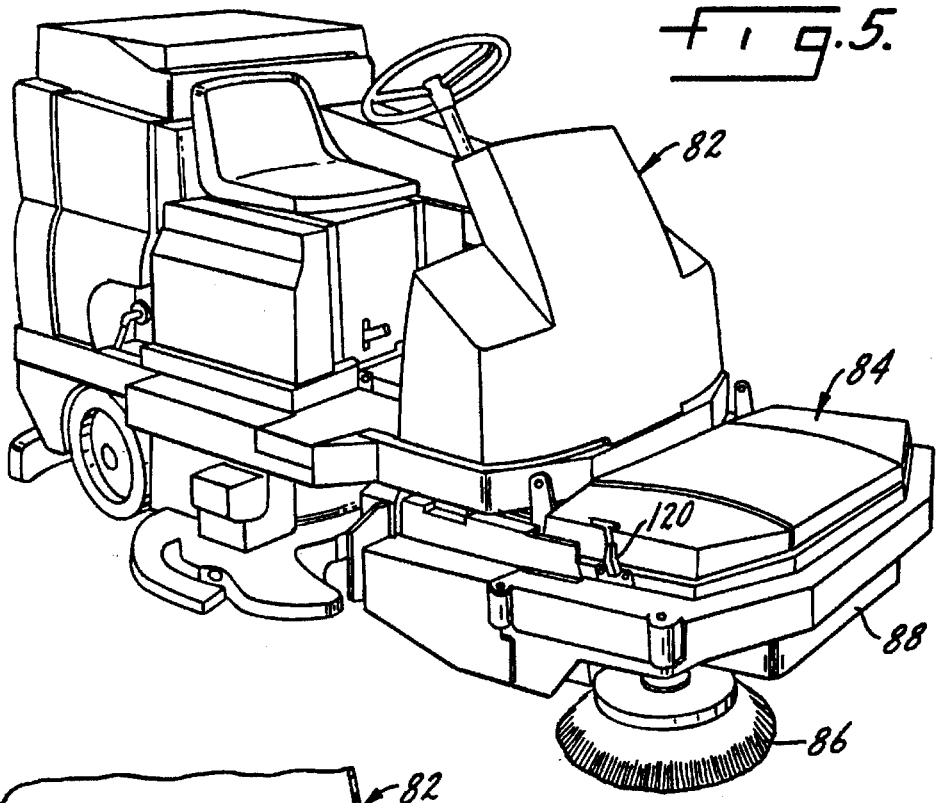
FIG. 5 is a perspective, similar to FIG. 1, showing a second type of sweeper embodying the invention disclosed herein.
Figure 6:
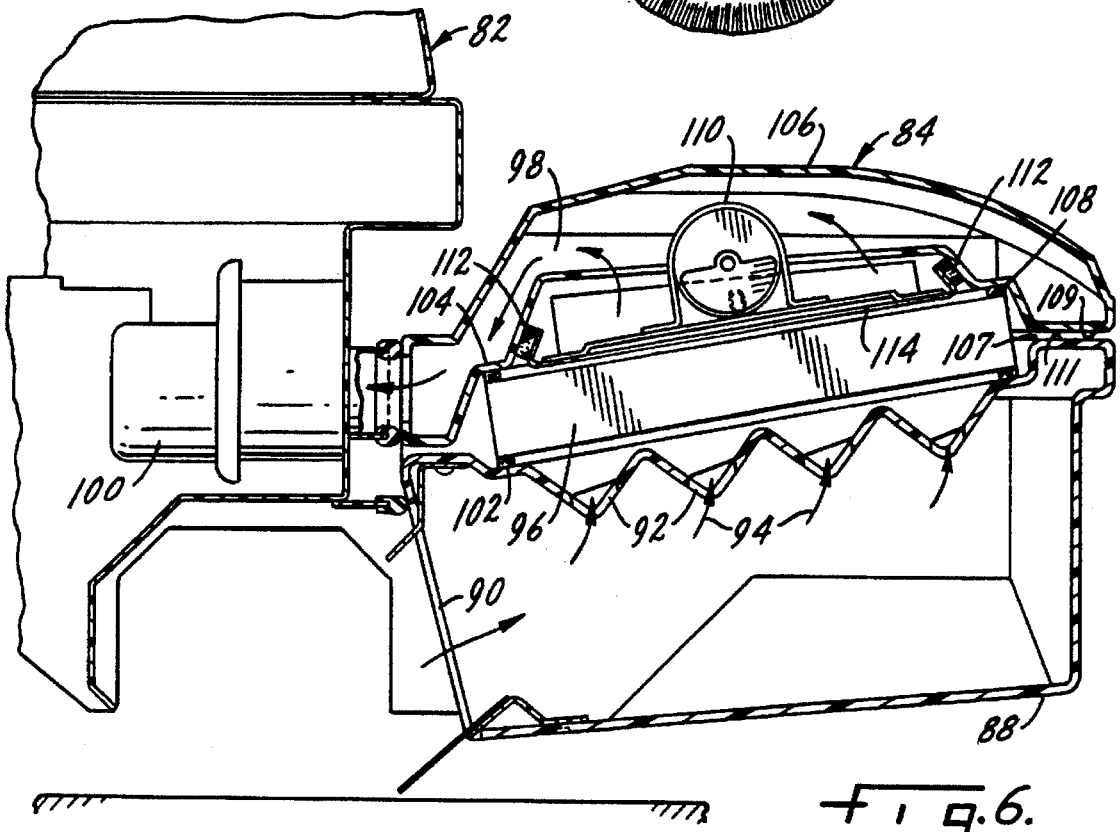
FIG. 6 is a vertical section, similar to FIG. 3, but showing the filter and filter cleaning system of the FIG. 5 sweeper.

In the embodiment of FIGS. 5 and 6, the sweeper is attached to a scrubbing machine indicated generally at 82. The sweeper, shown at 84, hangs off of the front of the scrubber and includes a brush 86 which will direct dust and debris into a hopper 88 through a hopper inlet opening 90. The top of the hopper has a plurality of openings 92 and there is an air flow path illustrated by arrows 94, through the hopper inlet 90, the hopper openings 92, the pleated filter element 96 into a chamber 98 positioned above the filter element. The air flow will then continue into a vacuum fan indicated at 100, there being a similar vacuum fan in the FIGS. 1–4 embodiment.

The inlet side of the filter element 96 is sealed to the hopper opening by a peripheral elastomeric seal 102. The outlet side of the filter element is sealed to a portion 104 of the cover 106 by a peripheral elastomeric seal 108. Thus, the FIGS. 5 and 6 embodiment has the floating double seal described earlier. There is an air gap 107 between facing surfaces 109 and 111 of the cover and hopper 88, respectively, which functions in the same way and for the same purpose as air gap 76.

The shaker 110, which may be similar to that described in the FIGS. 1–4 embodiment, has a pair of spaced foam cushions 112 which extend between the mounting plate 114 of the shaker and the lower wall 104 of the cover 106. Again, the shaker is yieldingly mounted to the cover which increases the vibratory motion provided by the shaker as its eccentric weight rotates. In the embodiment of FIGS. 5 and 6, the filter 96 may have an expanded metal upper surface and the shaker mounting plate 114 may sit directly upon this surface when it is mounted, as shown in FIG. 6.

In the FIGS. 5 and 6 embodiment, the cover 106 is attached to the hopper 88 by a pair of side latches 120. The cover is not hinged, but when the latches are released, the cover may be completely removed, which again provides access to both the filter and the shaker. In this embodiment the shaker is not attached to the underside of the cover, but is yieldingly mounted directly upon the filter 96 by the cushions 112 and the cover 106. When the cover is removed, the shaker may be removed from the filter so that the filter may be replaced or independently cleaned.

When the sweeper is operated, the air flow path shown by the arrows 94 will carry debris into the hopper and dust up through the filter, into the chamber within the cover 106, and then out to the vacuum fan. When it is desired to clean the filter, the shaker is rotated and the eccentric weight will provide vibratory motion to the filter. Again, the filter is mounted between upper and lower seals so that it floats in its normally suspended position. The vibratory motion of the shaker is enhanced by its cushioned mounting to the cover which thus provides a yielding downward force from the shaker to the filter.

As was the case with the embodiment in FIGS. 1–4, no tools are required for maintenance or removal of the shaker and the filter. The latches are undone, the cover 106 is removed, and the interior of the sweeper assembly is available for maintenance purposes.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine including a sweeping brush, a hopper having an inlet for receiving debris from said brush, an opening in said hopper, vacuum means for creating an air flow path from said hopper inlet and through said opening, a filter positioned in said opening, a peripheral flexible seal between an inlet side of said filter and said opening, vibratory cleaning means positioned adjacent an outlet side of said filter to impart vibration thereto, closure means enclosing said filter and cleaning means, a peripheral flexible seal between an outlet side of said filter and said closure means, said filter floating between said peripheral flexible seals whereby vibratory cleaning force applied to said filter from said vibratory cleaning means causes vibration of said filter.

2. The sweeping machine of claim 1 including an air gap between said hopper and said closure means, with said air gap providing an access means for air from outside of said sweeper to reach said peripheral flexible seal between the filter outlet side and the closure means.

3. The sweeping machine of claim 1 wherein said closure means is removable, and upon removal thereof, provides access and removal without tools of both said vibratory filter cleaning means and said filter.

4. The sweeping machine of claim 1 wherein said closure means is hinged to said filter sweeping machine.

5. The sweeping machine of claim 4 wherein there are spring-loaded floating hinges attaching said closure means to said machine.

6. The sweeping machine of claim 1 wherein said vibratory filter cleaning means is positioned directly against the outlet side of said filter.

7. The sweeping machine of claim 6 wherein said vibratory filter cleaning means is attached to said closure means.

8. The sweeping machine of claim 7 wherein the attachment of said vibratory filter cleaning means permits movement thereof relative to said closure means.

9. The sweeping machine of claim 8 wherein said yielding force is provided by a cushion between said closure means and said vibratory filter cleaning means.

10. The sweeping machine of claim 9 wherein said cushion is provided by at least one foam spring.

11. The sweeping machine of claim 1 wherein said closure means applies yielding pressure to said vibratory filter cleaning means to hold said vibratory cleaning means directly against the outlet side of said filter.

12. The sweeping machine of claim 1 wherein said vibratory filter cleaning means includes a motor and an eccentric weight, with rotation of said motor and weight applying vibratory motion to said filter.

13. The sweeping machine of claim 1 wherein said filter is generally horizontally disposed within said sweeping machine.

* * * * *